US007546743B2

(12) United States Patent
Bulman et al.

(10) Patent No.: US 7,546,743 B2
(45) Date of Patent: Jun. 16, 2009

(54) BOLTING CONFIGURATION FOR JOINING CERAMIC COMBUSTOR LINER TO METAL MOUNTING ATTACHMENTS

(75) Inventors: David Edward Bulman, Cincinnati, OH (US); Toby George Darkins, Jr., Loveland, OH (US); Mark Stewart Schroder, Hendersonville, NC (US); John Joseph Lipinski, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 118 days.

(21) Appl. No.: 11/247,129

(22) Filed: Oct. 12, 2005

(65) Prior Publication Data

US 2007/0240423 A1 Oct. 18, 2007

(51) Int. Cl.
*F23R 3/60* (2006.01)

(52) U.S. Cl. ..... 60/796; 60/753

(58) Field of Classification Search ..... 60/752, 60/753, 796, 799, 800
See application file for complete search history.

(56) References Cited

U.S. PATENT DOCUMENTS

| | | | | |
|---|---|---|---|---|
| 3,995,422 | A | 12/1976 | Stamm | 60/39.66 |
| 4,259,842 | A | 4/1981 | Koshoffer et al. | 60/757 |
| 4,485,630 | A | 12/1984 | Kenworthy | 60/757 |
| 4,896,510 | A | 1/1990 | Foltz | 60/757 |
| 4,944,149 | A | 7/1990 | Kuwata | 60/39.23 |
| 5,181,379 | A | 1/1993 | Wakeman et al. | 60/261 |
| 5,233,828 | A | 8/1993 | Napoli | 60/261 |
| 5,261,223 | A | 11/1993 | Folt | 60/39.36 |
| 5,279,127 | A | 1/1994 | Napoli | 60/754 |
| 5,291,732 | A | 3/1994 | Halila | 60/39.31 |
| 5,291,733 | A | 3/1994 | Halila | |
| 5,483,794 | A | 1/1996 | Nicoll et al. | 60/261 |
| 5,749,229 | A | 5/1998 | Abuaf et al. | 60/752 |
| 6,260,359 | B1 | 7/2001 | Monty et al. | 60/752 |
| 6,266,961 | B1 | 7/2001 | Howell et al. | 60/752 |
| 6,397,603 | B1 | 6/2002 | Edmondson et al. | |
| 6,408,629 | B1 | 6/2002 | Harris et al. | 60/804 |
| 6,513,331 | B1 | 2/2003 | Brown et al. | 60/754 |
| 6,526,756 | B2 | 3/2003 | Johnson et al. | 60/772 |
| 6,543,233 | B2 | 4/2003 | Young et al. | 60/752 |
| 6,568,079 | B2 | 5/2003 | Farmer et al. | 29/890.01 |
| 6,581,285 | B2 | 6/2003 | Emilianowicz | 29/890.01 |

(Continued)

OTHER PUBLICATIONS

European Search Report for Application No. EP 06 25 4132 on Mar. 15, 2007, in Munich.

(Continued)

*Primary Examiner*—Louis J Casaregola
(74) *Attorney, Agent, or Firm*—Nixon & Vanderhye, P.C.

(57) ABSTRACT

A gas turbine combustor includes a substantially cylindrical combustor liner located substantially concentrically within a flow sleeve, the combustor liner composed through a ceramic matrix composite material, a forward end of the combustor liner provided with a plurality of circumferentially arranged bolt holes. An inner metal ring is located about an outside surface of the forward end of the combustor liner, the inner metal ring provided with a second plurality of circumferentially spaced bolt holes, with a plurality of bolts extending through the first and second pluralities of bolt holes and secured by self-locking nuts. An outer metal ring is spaced radially outwardly of the inner metal ring, with a plurality of circumferentially spaced struts extending between the inner and outer rings.

18 Claims, 4 Drawing Sheets

U.S. PATENT DOCUMENTS

| | | | | |
|---|---|---|---|---|
| 6,644,034 | B2 * | 11/2003 | Ariyoshi et al. | 60/800 |
| 6,651,437 | B2 | 11/2003 | Farmer et al. | 60/752 |
| 6,655,146 | B2 | 12/2003 | Kutter et al. | 60/752 |
| 6,655,148 | B2 * | 12/2003 | Calvez et al. | 60/753 |
| 6,655,149 | B2 | 12/2003 | Farmer et al. | 60/754 |
| 6,681,578 | B1 | 1/2004 | Bunker | 60/772 |
| 6,732,532 | B2 | 5/2004 | Camy et al. | |
| 6,761,031 | B2 | 7/2004 | Bunker | 60/752 |
| 2002/0184886 | A1 | 12/2002 | Calvez et al. | |
| 2005/0050902 | A1 | 3/2005 | Anichini et al. | |
| 2006/0242965 | A1 * | 11/2006 | Shi et al. | 60/796 |

OTHER PUBLICATIONS

Partial European Search Report No. EP 06 25 4132 on Jan. 9, 2007, in Munich.

* cited by examiner

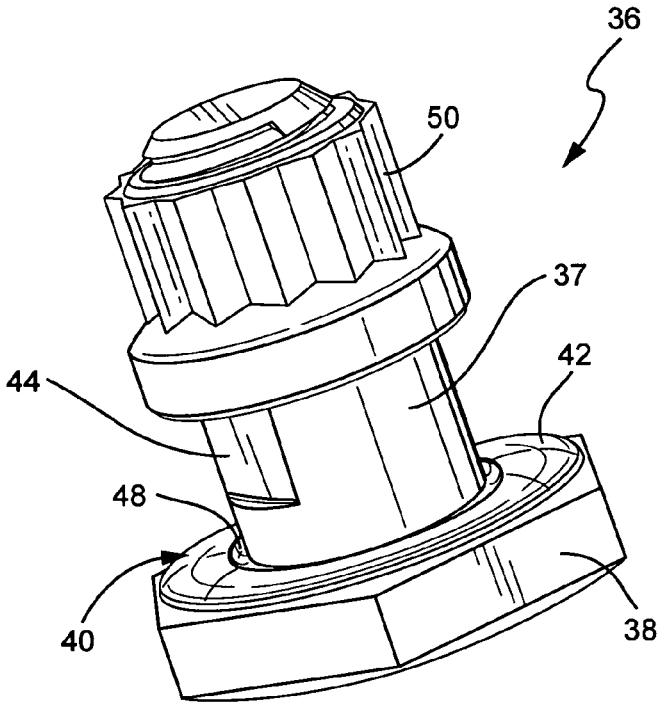
Fig. 4
Fig. 5
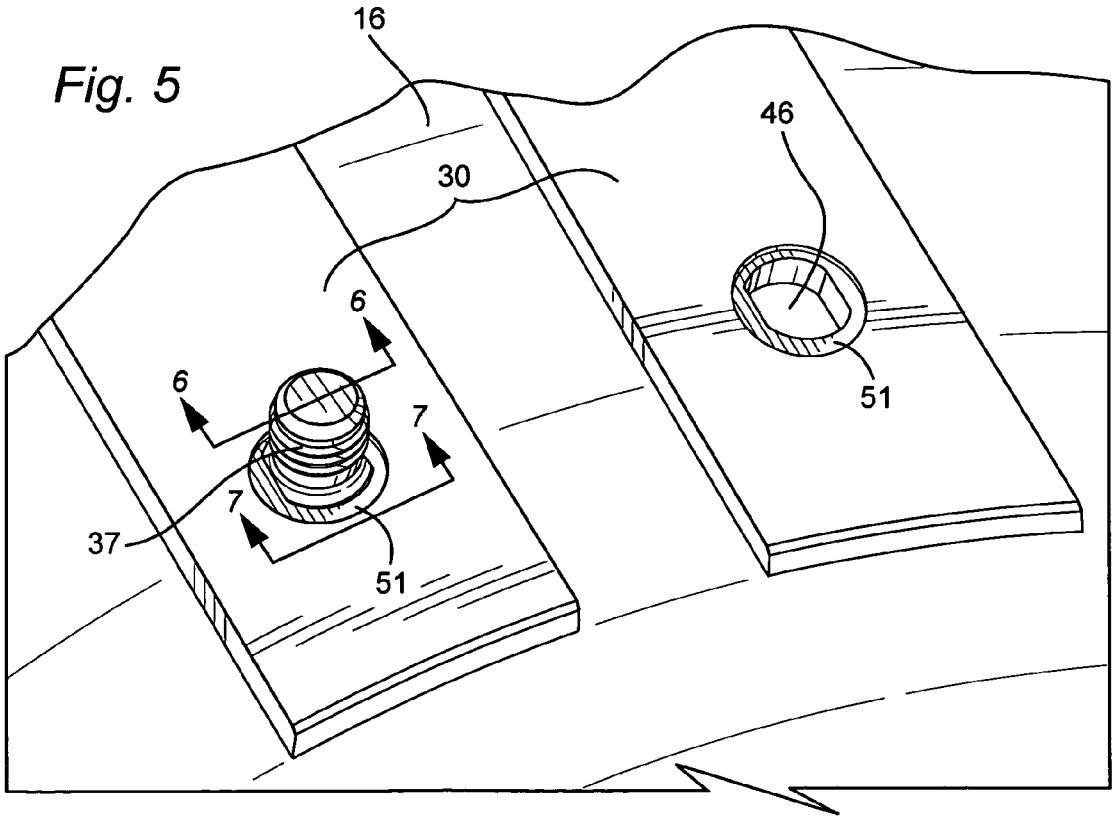

BOLTING CONFIGURATION FOR JOINING CERAMIC COMBUSTOR LINER TO METAL MOUNTING ATTACHMENTS

BACKGROUND OF THE INVENTION

This invention relates generally to rotating machine technology and, specifically, to an attachment system for securing a ceramics matrix composite combustor liner to metal mounting attachments in a turbine combustor.

Advanced gas turbine engine development has suggested for use in high-temperature applications such as turbine combustor liners, certain non-metallic materials having higher temperature capability than the metal materials currently in use. One specific class of such non-metallic, low thermal expansion materials is ceramic matrix composite (CMC) materials which can operate at significantly higher temperatures than metals, and allow greatly reduced cooling requirements that can be translated into increased engine efficiency and output. With higher temperature capability, CMC materials can also simultaneously allow a reduction in combustor pressure drop by deleting conventional cooling enhancement features such as turbulators.

In order to realize the benefit of operating a gas turbine with a CMC liner, however, new methods of mounting CMC liners that accommodate the low coefficient of thermal expansion of the CMC material as well as the comparatively low strain-to-failure of CMC's relative to conventional metallic materials, must be developed. Thus, the challenge in using CMC materials for combustor liners is developing the interfaces to existing metal hardware in a cost-effective system that meets life and cost requirements.

For metal combustor liners, attachment components or features are readily joined to the metallic liner by brazing, welding, staking or other well-developed and reliable joining methods. Such attachment features typically provide support for cylindrical liners in the radial, axial and tangential directions.

For example, a typical three lug metal liner mounting arrangement provides for a radially floating design that semi-determinately captures three blocks on the metal liner into flow sleeve lugs. Forward axial loads from the combustor liner are reacted into the brazed blocks. With stack-up tolerances and forward to aft concentricity misalignment, this configuration could reasonably take all of the normal operating loads through a single lug. Examples of this technology may be seen in commonly owned U.S. Pat. Nos. 5,274,991; 5,323,600; 5,749,218; 6,279,313 and 6,216,442. These designs are not appropriate for CMC liners, however, because it is not feasible to braze or weld metal blocks to the CMC liner.

CMCs have mechanical properties that must be carefully considered during design and application of an article such as a combustor liner which interfaces with metallic hardware of significantly higher strength and higher thermal expansion characteristics. While some fastening techniques have been developed for securing CMC liners to metal components (See, for example, U.S. Pat. Nos. 6,904,757; 6,895,761; 6,895,757; 6,854,738 and 6,658,853.), there remains a need for a relatively simple but effective attachment system for CMC liners in gas turbine combustors.

BRIEF DESCRIPTION OF THE INVENTION

In an exemplary embodiment of this invention, a rigid attachment between a CMC combustor liner and metal mounting attachments is provided. Specifically, a unique fastening system provides for positive clamping to allow loadings in the CMC liner to be carried in friction and thus insure adequate design life. The fastening configuration disclosed herein transfers the manufacturing complexity to the bolt itself, thereby simplifying fabrication of the CMC combustor liner.

More specifically, the CMC liner axial pressure load is carried positively in friction by a clamped fastener configuration that can be treated against susceptibility to wear in the high-vibration gas turbine environment. The clamped joint configuration utilizes a combination of metals to compensate for the low CTE of the CMC liner to maintain clamping forces at elevated operating temperatures enabling this attachment system to carry operating loads in friction.

In the exemplary embodiment, the liner is centered from the inside at installation, in conventional fashion, by hula seals on both forward and aft ends of the liner. The forward end of the liner is attached to an annular inner ring fitted over the liner. Specifically, a plurality of specially-designed fasteners pass through holes in the CMC liner and aligned holes in radially compliant, circumferentially spaced spring fingers that project from a solid hoop portion of the inner ring. Each spring finger is curved to match the curvature of the liner. The inner ring is attached to a radially outer ring by a plurality of circumferentially spaced radial struts, and the assembly is mounted so as to float with both axial and radial motion permitted to a limited degree. The fasteners employed in the exemplary embodiment to secure the inner ring to the CMC liner are threaded bolts with thin but oversized heads formed with integral washers, used along with self-locking nuts.

The washer face of the specialized bolt is cylindrically contoured to match the unmachined surface of the CMC liner. In order to insure proper alignment of the contoured washer face during assembly, its orientation is controlled by a slab-sided hole in the metal spring fingers that is sized to receive corresponding slab-sided shank portions on the bolts. Self-locking nuts are adapted to seat on countersunk flats on the spring fingers.

In another exemplary embodiment, a cylindrically contoured spacer may be employed under the bolt head to interface with the CMC liner.

In still another embodiment, a high CTE spacer could be located under the self-locking nut to compensate for the low CTE of the CMC liner. Other similar scenarios utilizing a secondary component to accommodate the difference in CTE between the bolt and the CMC liner could be envisioned similar to this spacer and part of normal mechanical design procedures.

Accordingly, in one aspect, the present invention relates to a combustor liner for a gas turbine comprising a substantially cylindrical combustor liner body composed of ceramic matrix composite material, having an enlarged diameter portion at an aft end thereof, the enlarged diameter portion provided with a circumferential array of bolt holes.

In another aspect, the invention relates to a gas turbine combustor comprising a substantially cylindrical combustor liner located substantially concentrically within a flow sleeve, the combustor liner composed of a ceramic matrix composite material, a forward end of the combustor liner provided with a first plurality of circumferentially arranged bolt holes; an inner metal ring located about an outside surface of the forward end of the combustor liner, the inner metal ring provided with a second plurality of circumferentially spaced bolt holes; and a plurality of bolts extending through the first and second pluralities of bolt holes.

In still another aspect, the invention relates to a gas turbine combustor comprising a substantially cylindrical combustor liner located substantially concentrically within a flow sleeve, the combustor liner composed of a ceramic matrix composite material, a forward end of the combustor liner provided with a first plurality of circumferentially arranged bolt holes; an inner metal ring located about an outside surface of the forward end of the combustor liner, the inner metal ring having a solid annular portion and a plurality of axially extending, circumferentially spaced spring fingers, with a second plurality of circumferentially spaced bolt holes located in respective ones of the spring fingers; and a plurality of bolts extending through the first and second pluralities of bolt holes; wherein a self-locking nut is threadably secured to each bolt and engaged with a radially outer surface of a respective spring finger; and wherein the second plurality of bolt holes are each formed with a slab-sided counter bore adapted to receive a slab-sided shank portion of a respective one of the bolts.

The invention will now be described in detail in connection with the drawings identified below.

BRIEF DESCRIPTION OF THE DRAWINGS

FIG. 4 is a perspective view of a nut and bolt used in the attachment hardware assembly shown in FIGS. 1 and 3;

FIG. 5 is a partial perspective showing the interaction between the inner ring spring fingers, liner and bolt in accordance with an exemplary embodiment of the invention;

DETAILED DESCRIPTION OF THE INVENTION

Figure 1:
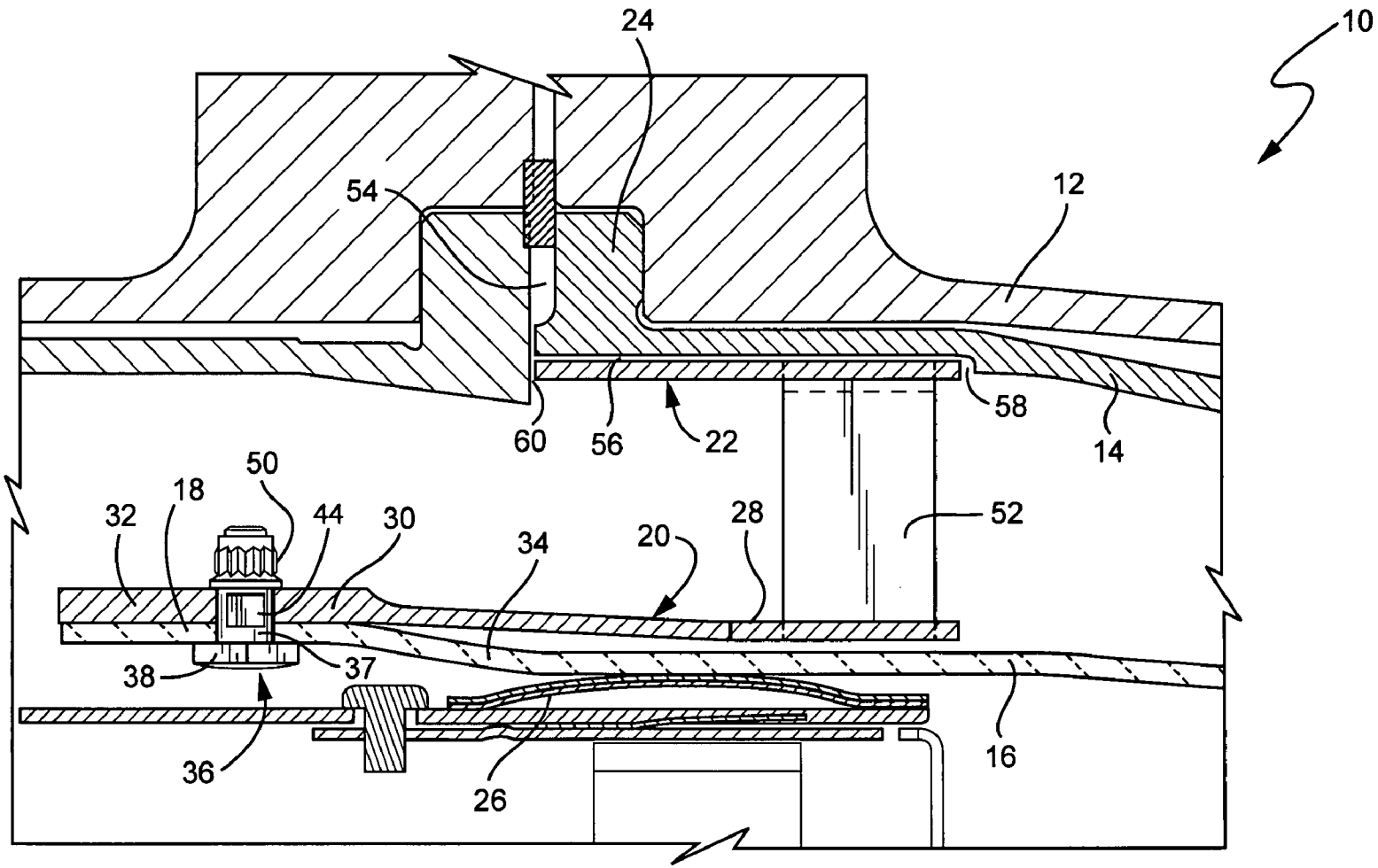
FIG. 1 is a partial cross-section through a ceramic combustor liner incorporating the dual-ring attachment hardware assembly in accordance with an exemplary embodiment of the invention.
Figure 2:
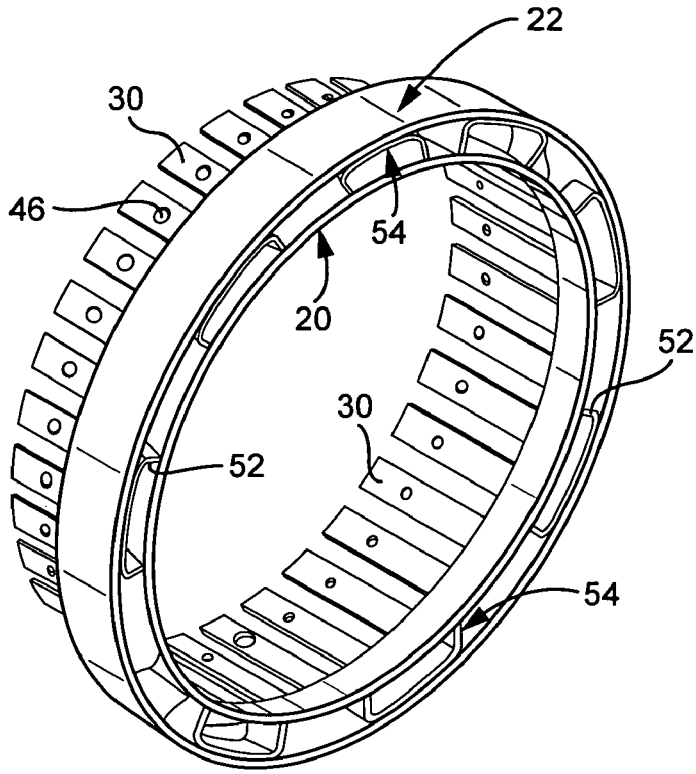
FIG. 2 is a perspective view of a dual-ring attachment hardware assembly for a ceramic combustor liner.
Figure 3:
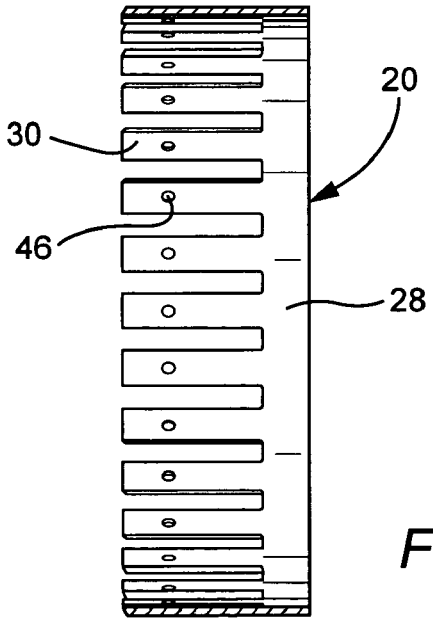
FIG. 3 is a side section taken through the inner ring shown in FIG. 1.
Figure 6:
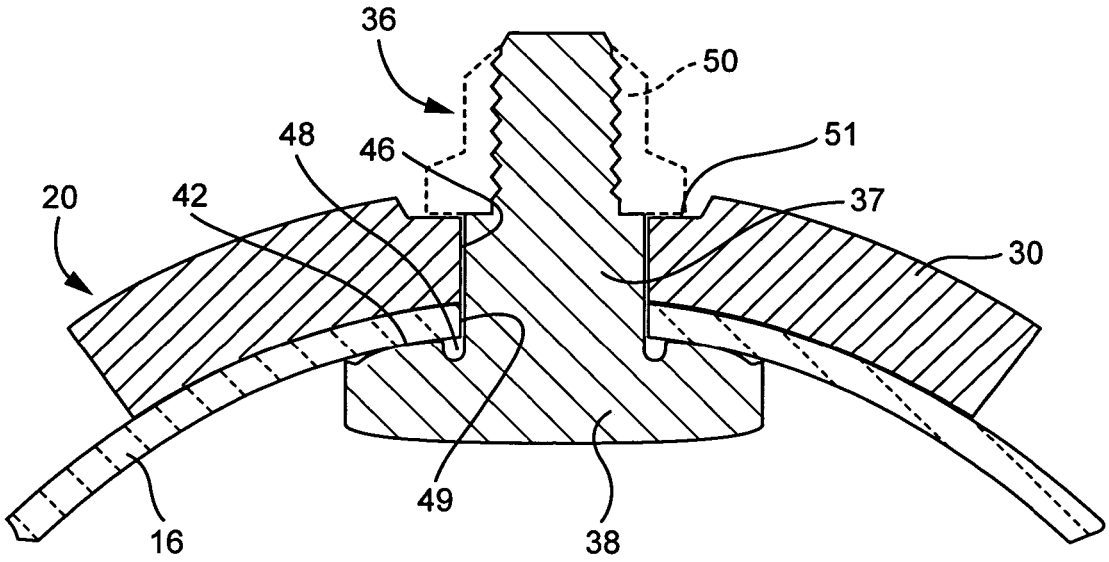
FIG. 6 is a section taken along the line 6-6 of FIG. 5, with the locking nut added.
Figure 7:
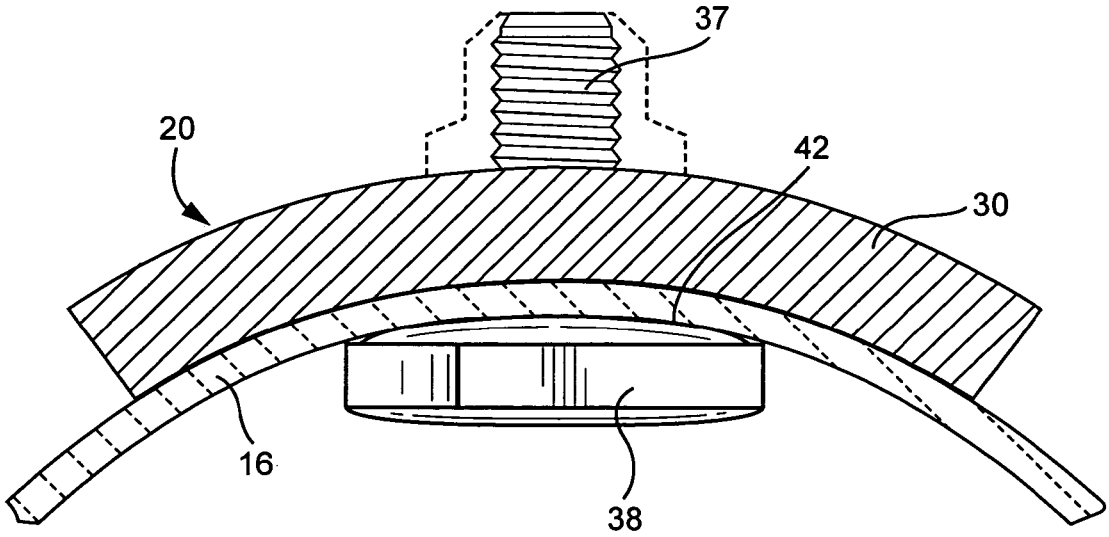
FIG. 7 is a section taken along the line 7-7 of FIG. 5.

FIGS. 1 and 2 illustrate a liner configuration for a turbine combustor 10 that includes a combustor casing 12, a radially outer flow sleeve 14 and a radially inner combustor liner 16. The liner 16 and flow sleeve 14 are substantially concentrically arranged within the casing 12, and the invention here relates primarily to the manner in which the forward end 18 of the liner is secured to an inner ring 20 that is in turn attached to a radially outer attachment ring 22.

In the exemplary embodiment, the liner 16 is made of a non-metallic, low thermal expansion CMC material that can operate at significantly higher temperatures with reduced cooling requirements.

In order to connect the CMC combustor liner 16 to the metallic attachment hardware at the forward end 18 of the liner, the latter is initially centered from within by conventional hula seals 26 on both the forward and aft ends of the liner. The inner, annular attachment ring 20 is telescoped over the forward end 18 of the liner. The attachment ring 20 is formed with a solid ring or band portion 28 at its rearward end, with a plurality (e.g., 32) of radially compliant metal spring fingers 30 extending forwardly therefrom. Fingers 30 are equally spaced about the circumference of the liner, and are curved to match the curvature of the liner. The forward ends 32 of the fingers engage the forward end 18 of the liner which, optionally, may be thickened relative to the remainder of the inner attachment ring for increased strength. The diameter of the liner is also enlarged at its forward end 18 via a tapered portion 34 to insure assembly clearances.

A plurality of fasteners 36 serve to clamp the ends 32 of the fingers 30 to the forward end 18 of the liner. Fasteners 36 in the exemplary embodiment are in the form of threaded bolts having threaded shanks 37 and thin but oversized cylindrical heads 38 with integral washers 40 (see FIGS. 4-7) the faces 42 of which are contoured to match the curved inner surface of the liner 16. By cylindrically contouring the washer face to match the unmachined curved surface of the forward portion 18 of the liner 16, there is no need to spot-face the CMC liner. The bolts 36 also have flats or slabs 44 formed in the shank portions 37 that fit in complementary slab-sided holes 46 (FIG. 5) in the fingers 30. If not for the combination of the orientation-controlling bolt shank and curved washer face, the enabling benefits of the contoured washer face would be lost. In other words, this combination of the specialized cylindrical washer face 42 and slab-sided bolt holes 46 in the radially compliant attachment fingers 30 and complimentary bolt shank portion 44 allow the assembly clamp load to be high enough to carry the transverse normal operating loads of the joint in friction. Note also that the inner diameter of the washer face 42 is increased to accommodate a shank-to-head undercut 48 required to provide manufacturing access to create the cylindrical washer face 42. The offset created by the undercut also reduces the size of any chamfer in the round CMC liner holes 49 required to clear a head-to-shank fillet.

Self-locking nuts 50 are employed to securely clamp the components together, and the exterior surfaces of the inner ring fingers 30 are formed with a like number of countersunk flats 51 that receive the nuts 50.

Returning to FIGS. 1 and 2, at the rearward end of the inner attachment ring 20, the solid ring portion 28 is connected by a plurality of axially-oriented radial struts 52 to the outer attachment ring 22. In the exemplary embodiment, there are sixteen such struts which may be provided in pairs in the form of substantially U-shaped segments 54 spaced about the circumference of the inner ring 20. These segments 54 may be plug-welded to the outer ring 22, with the strut portions 52 butt-welded to the inner ring 20. The outer ring 22 extends forwardly, radially inwardly of the flange 24 of the flow sleeve 14, which is captured in an annular groove 54 in the combustor casing in otherwise conventional fashion. In the exemplary embodiment, the ratio of the number of fingers 30 to the number of radial struts is optimized at 2 to 1, but other applications may require a different ratio.

A radial gap 56 between the outer ring 22 and flow sleeve 14 permits the CMC liner a limited degree of radial float, while gaps 58, 60 forward and aft of the outer ring 22, permit a limited degree of axial float.

Note that the bolted joint is executed in a cooled, low stress area of the CMC liner 16 at temperatures well within the material limitations of the metallic components, specifically the bolts 36 and self-locking nuts 50. The radial load in this configuration is a separating load on the bolted joint, and the assembly clamp load is sized to carry this separating load without loss in clamping force at operating temperature. In this regard, the radially compliant forward attachment fingers 30 must be sized flexibly enough so that this separating load does not compromise the operating clamp of the joint. The fingers 30 are therefore sized in thickness and length to be able to support the axial loads resulting from the differential pressure on the liner 16 while allowing the fingers to deflect radially to accommodate the difference in thermal growth of the low CTE CMC liner 16 and the higher CTE metal inner ring 20 that connects to the outer ring 22 by the radial struts 52.

The invention as described herein provides radial, tangential and axial support for a cylindrical/conical CMC combustor liner 16. The radially compliant forward attachment (inner ring 20 and fingers 30) reacts the pressure load on the inner liner that creates a net forward load on the liner along the cylindrical axis of the liner. In the ultimate case of a trip load on the turbine, the pressure loads can increase by over a factor of 2. This abnormal load may be carried by friction if the coefficient of friction is high enough. If friction is insufficient, then the shanks of the bolts 36 would carry the 2× pressure load in shear. In either case, sliding wear between the CMC material and metal fingers 30 on the forward attachment is minimized.

An alternate embodiment of the present invention could include the use of a cylindrically contoured spacer under the bolt head 36 to interface with the CMC liner 16 and eliminate the need for a spot-face on the inner cylindrical surface of the liner.

Another alternate embodiment could include locating a high CTE spacer under the nut 50 to compensate for the low CTE of the CMC liner 16.

While the invention has been described in connection with what is presently considered to be the most practical and preferred embodiment, it is to be understood that the invention is not to be limited to the disclosed embodiment, but on the contrary, is intended to cover various modifications (including materials other than CMC) and equivalent arrangements included within the spirit and scope of the appended claims.

What is claimed is:

1. A gas turbine combustor comprising a substantially cylindrical combustor liner located substantially concentrically within a flow sleeve, said combustor liner composed of a ceramic matrix composite material, a forward end of said combustor liner provided with a first plurality of circumferentially arranged bolt holes; an inner metal ring located about an outside surface of said forward end of said combustor liner, said inner metal ring provided with a second plurality of circumferentially spaced bolt holes; and a plurality of bolts extending through said first and second pluralities of bolt holes to thereby secure one end of said inner metal ring to said combustor liner; and wherein said inner metal ring comprises a solid annular portion and a plurality of axially extending, circumferentially spaced spring fingers, said second plurality of circumferentially spaced bolt holes located in respective ones of said spring fingers.

2. The gas turbine combustor of claim 1 wherein a self-locking nut is threadably secured to each bolt and engaged in a countersunk flat formed in a radially outer surface of a respective spring finger.

3. The gas turbine combustor of claim 2 and further comprising a first plurality of resilient metal seals engaged with a radially inner surface of said combustor liner, at said forward end of said liner.

4. The gas turbine combustor of claim 3 and further comprising a second plurality of resilient metal seals engaged with said radially inner surface of said combustor liner, at an aft end of said liner.

5. The gas turbine combustor of claim 1 wherein said second plurality of bolt holes of said inner metal ring are each formed with a slab-sided counter bore adapted to receive a slab-sided shank portion of said bolts.

6. The gas turbine combustor of claim 1 and further comprising an outer metal ring spaced radially outward of said inner metal ring, with a plurality of circumferentially spaced struts extending between said inner and outer rings.

7. The gas turbine combustor of claim 6 wherein said circumferentially spaced struts are provided in pairs, each pair connected by a curved segment fixed to said outer metal ring.

8. A gas turbine combustor comprising a substantially cylindrical combustor liner located substantially concentrically within a flow sleeve, said combustor liner composed of a ceramic matrix composite material, a forward end of said combustor liner provided with a first plurality of circumferentially arranged bolt holes; an inner metal ring located about an outside surface of said forward end of said combustor liner, said inner metal ring having a solid annular portion and a plurality of axially extending, circumferentially spaced spring fingers, with a second plurality of circumferentially spaced slab-sided bolt holes located in respective ends of said spring fingers; and a plurality of bolts extending through said first and second pluralities of bolt holes to thereby secure said inner metal ring to said combustor liner; wherein a self-locking nut is threadably secured to each bolt and engaged with a radially outer surface of a respective spring finger; and wherein said slab-sided bolt holes are each adapted to receive a slab-sided shank portion of a respective one of said bolts.

9. The gas turbine combustor of claim 8 and further comprising an outer metal ring spaced radially outward of said inner metal ring, with a plurality of circumferentially spaced, radial struts extending between said inner and outer rings.

10. The gas turbine combustor of claim 9 wherein said circumferentially spaced struts are provided in pairs, each pair connected by a curved segment fixed to said outer metal ring.

11. The gas turbine combustor of claim 10 wherein said segments are welded to said outer ring and said struts are welded to said inner ring.

12. The gas turbine combustor of claim 8 wherein each of said bolts has an integral washer face with a cylindrically curved face.

13. The gas turbine combustor of claim 12 wherein said cylindrically curved face substantially matches a curvature of said combustor liner and wherein said slab-sided counter bore and said slab-sided shank are oriented to align said curved face with the curvature of said combustor liner.

14. The gas turbine combustor of claim 9 wherein a ratio of number of spring fingers to number of radial struts is 2 to 1.

15. The gas turbine combustor of claim 9 wherein said outer metal ring is sized and shaped such that radial and axial gaps are established between said liner and said flow sleeve, thus permitting limited radial and axial float of said liner relative to said flow sleeve.

16. A gas turbine combustor comprising a substantially cylindrical combustor liner located substantially concentrically within a flow sleeve, said combustor liner composed of a ceramic matrix composite material, a forward end of said combustor liner provided with a first plurality of circumferentially arranged bolt holes; an inner metal ring located about an outside surface of said forward end of said combustor liner, said inner metal ring provided with a second plurality of circumferentially spaced bolt holes; and a plurality of bolts extending through said first and second pluralities of bolt holes to thereby secure one end of said inner metal ring to said combustor liner, an opposite end of said inner metal ring provided with a plurality of radially extending struts connecting said opposite end of said inner metal ring to a radially outer metal ring located in proximity to said flow sleeve such that a limited degree of radial and axial float is permitted between said combustor liner and said flow sleeve.

17. The gas turbine combustor of claim 16 wherein said inner metal ring comprises a solid annular portion and a plurality of axially extending, circumferentially spaced spring fingers, said second plurality of circumferentially spaced bolt holes located in respective ones of said spring fingers.

18. The gas turbine combustor of claim 17 wherein a self-locking nut is threadably secured to each bolt and engaged in a countersunk flat formed in a radially outer surface of a respective spring finger.

* * * * *

UNITED STATES PATENT AND TRADEMARK OFFICE

CERTIFICATE OF CORRECTION

PATENT NO. : 7,546,743 B2
APPLICATION NO. : 11/247129
DATED : June 16, 2009
INVENTOR(S) : David Bulman et al.

It is certified that error appears in the above-identified patent and that said Letters Patent is hereby corrected as shown below:

In Column 1, immediately below the title, insert:

--This invention was made with Government support under contract number DE-FC26-00CH11047 awarded by the Department Of Energy. The Government has certain rights in this invention.--

Signed and Sealed this

Sixth Day of April, 2010

David J. Kappos

David J. Kappos
*Director of the United States Patent and Trademark Office*